US007147433B2

(12) United States Patent
Ghizawi

(10) Patent No.: US 7,147,433 B2
(45) Date of Patent: Dec. 12, 2006

(54) PROFILED BLADES FOR TURBOCHARGER TURBINES, COMPRESSORS, AND THE LIKE

(75) Inventor: Nidal A. Ghizawi, Torrance, CA (US)

(73) Assignee: Honeywell International, Inc., Morristown, NJ (US)

( * ) Notice: Subject to any disclaimer, the term of this patent is extended or adjusted under 35 U.S.C. 154(b) by 110 days.

(21) Appl. No.: 10/716,651

(22) Filed: Nov. 19, 2003

(65) Prior Publication Data

US 2005/0106013 A1 May 19, 2005

(51) Int. Cl.
*F01D 17/16* (2006.01)
*F01D 5/14* (2006.01)

(52) U.S. Cl. ..... 415/164; 416/183; 416/185; 416/188; 416/223 A; 416/223 B; 416/228; 416/235; 416/237

(58) Field of Classification Search ..... 415/159–160, 415/163–165, 203–206, 208.3, 208.4, 211.1; 416/183, 185, 186 R, 188, 223 A, 223 B, 416/228, 235, 237
See application file for complete search history.

(56) References Cited

U.S. PATENT DOCUMENTS

| | | | | | |
|---|---|---|---|---|---|
| 2,392,858 | A * | 1/1946 | McMahan | 416/186 R |
| 3,146,722 | A * | 9/1964 | Warman | 415/205 |
| 4,006,997 | A * | 2/1977 | Friberg et al. | 416/185 |
| 4,629,396 | A * | 12/1986 | Lorett | 415/164 |
| 4,702,672 | A * | 10/1987 | Leicht et al. | 415/164 |
| 4,878,810 | A | 11/1989 | Evans | |
| 5,342,168 | A * | 8/1994 | Weigel et al. | 415/148 |
| 5,480,285 | A | 1/1996 | Patel et al. | |
| 5,595,473 | A * | 1/1997 | Nagaoka et al. | 415/208.3 |
| 6,042,338 | A | 3/2000 | Brafford et al. | |
| 6,269,642 | B1 | 8/2001 | Arnold et al. | |
| 6,419,464 | B1 | 7/2002 | Arnold | |
| 6,742,989 | B1 * | 6/2004 | Osako et al. | 415/205 |
| 6,877,955 | B1 * | 4/2005 | Higashimori et al. | 416/185 |

FOREIGN PATENT DOCUMENTS

| | | | | |
|---|---|---|---|---|
| DE | 1016888 | A * | 10/1957 | 416/186 R |
| EP | 1304445 | | 4/2003 | |
| GB | 626290 | A * | 4/1950 | 415/208.4 |
| JP | 05340265 | | 12/1993 | |
| JP | 11006401 | | 1/1999 | |
| JP | 11190201 | | 7/1999 | |
| SU | 373438 | A * | 7/1973 | 416/185 |
| WO | PCT/US2004/038767 | | 4/2005 | |

* cited by examiner

*Primary Examiner*—Christopher Verdier
(74) *Attorney, Agent, or Firm*—Chris James

(57) ABSTRACT

A rotor and an apparatus including a rotor are provided. For example, the apparatus can be a turbine or compressor having a housing in which the rotor rotates while gas is circulated therethrough. The rotor has a plurality of radially extending blades, and each blade defines a nonlinear profile along at least one edge so that the strains induced in the blade during operation are reduced. A method for manufacturing such a rotor is also provided.

14 Claims, 9 Drawing Sheets

PROFILED BLADES FOR TURBOCHARGER TURBINES, COMPRESSORS, AND THE LIKE

FIELD OF THE INVENTION

The present invention relates generally to rotary apparatuses such as turbines and compressors that circulate a gas in a turbocharger and, more particularly, to an apparatus with a rotor having blades that define a nonlinear profile along at least one edge.

BACKGROUND OF THE INVENTION

Radial turbines and compressors, such as those used in turbochargers, typically include a rotor, or wheel, that is rotatably mounted in a housing and that defines blades extending radially outward in proximity to an inner surface of the housing. The housing defines an inlet for receiving air or other gas, and an outlet through which the gas is circulated. In the case of a turbine, the rotor is a turbine wheel that is rotatably mounted in a turbine wheel housing. Gas, such as exhaust gas from an internal combustion engine, flows into the housing through the inlet, which extends circumferentially around the wheel, and exits in a generally axial direction. As the gas passes through the housing, the turbine wheel is rotated. In a typical turbocharger, the turbine wheel is connected by a shaft to a compressor wheel, i.e., a rotor, that is rotatably mounted in a compressor wheel housing. The compressor wheel housing also defines an inlet and outlet, and the compressor wheel includes radial blades that deliver air through the compressor wheel housing. In particular, the compressor wheel draws air axially inward through the inlet and delivers the air radially outward through a diffuser that extends circumferentially around the compressor wheel.

The blades of the rotors of turbines and compressors typically have edges that are positioned in close proximity to the housing and other relatively stationary components. For example, the turbines and compressors of modern turbochargers can include stators at the inlet and/or outlet to control the flow of gas through the device. In a turbine, the stators can be vanes arranged circumferentially at the inlet to define a stationary or an adjustable nozzle. The nozzle can be selectively opened and closed to control the flow of the gas through the turbine. In a compressor, the stators can be vanes that are arranged circumferentially at the outlet to define a variable diffuser that controls the flow of the air through the compressor. Due to the close proximity of the rotors and stators, the high rotational speeds of the rotors, and the high operating pressures, the blades of the rotors are subject to unsteady aerodynamic excitation forces that induce alternating strains and stresses in the blades. Such unsteady, or cyclic, excitation forces can similarly result from other stationary or adjustable components such as inlet guide vanes or a curved inlet manifold that supplies the gas to the inlet at pressures that vary across the area of the inlet. For example, inlet guide vanes are often provided in the inlet of a compressor to direct the flow of air therethrough. Thus, the blades are cyclically stressed at frequencies associated with the rotational speed of the rotor and the number and location of the vanes or other stationary components. Such cyclic stress can result in fatigue and failure of the rotors.

A forced response analysis can be conducted during the design of a rotary device such as a turbine or compressor to determine the cyclic stresses and strains on the rotor due to any unsteady aerodynamic excitation forces that occur at the rotor's resonant frequencies. The unsteady aerodynamic mechanical response of the rotor can be first analyzed, e.g., by conducting a computational fluid dynamics (CFD) analysis to determine the unsteady aerodynamic excitation forces, and conducting a 3-dimensional finite element method (FEM) analysis to determine the natural resonant frequencies of the rotor. Typically, the geometric configuration of the rotor or other components of the device is adjusted or modified as is practical to reduce the stresses and strains of the rotor that result from the unsteady aerodynamic excitation forces, e.g., by adjusting the configuration of the rotor or other devices such that the resonant frequencies occur outside the operating range of the rotor. The normal operating range of the device may be such that the rotor is not significantly stressed when subjected to cyclic aerodynamic forces that correspond to the lowest of the resonant frequencies of the rotor due to the low speed and pressure associated with that speed of operation. However, it is often impossible or impractical to adjust the higher resonant frequencies out of the operating speed range of the turbocharger. Thus, for example, the rotor may be subjected during some times of operation to a cyclic aerodynamic excitation force having a frequency that is equal to the second mode or higher modes of the resonant vibratory frequency of the rotor. Accordingly, the design analysis can include determining the strains and stresses that occur in the rotor at such frequencies and verifying that the expected life of the rotor meets a minimum design criteria. In some cases, however, the rotor may be subjected to alternating strains that reduce the expected life of the rotor below a minimum design criteria.

Thus, there exists a need for improved rotors for rotary devices such as turbines and compressors that are used in turbochargers, and for a method of manufacturing such devices. Preferably, the devices should be subjected to reduced strains and stresses, thereby extending the operating lives of the devices, despite cyclic aerodynamic excitation forces, which can occur throughout the operating range of the device, including at one or more of the vibratory modes of the rotor of the device.

BRIEF SUMMARY OF THE INVENTION

The present invention provides a rotor, such as turbine wheel or compressor wheel, as well as a rotary apparatus and an associated method. According to one embodiment of the present invention, a turbine wheel is connected to a shaft and configured to be rotated with the flow of gas through a housing to thereby rotate the shaft. The wheel includes a body portion and a plurality of blades. The body portion is configured to rotate about an axis, and the blades extends radially outward from the body portion. Each blade defines first and second edges, with the first edge extending generally radially and the second edge extending generally axially, and the second edge being a leading edge of the blade that defines a nonlinear, concavely curved profile in radial-axial projection. In one embodiment, the profile of the second edge extends smoothly and continuously from a first end to a second end in a generally axial direction, with the first and second ends extending radially to a greater extent than a mid-point of the profile between the first and second ends. A rotary apparatus according to one embodiment of the present invention is configured to circulate a gas. The apparatus includes a housing defining an inlet and an outlet, a rotor with a body portion and radially extending blades disposed in the housing and configured to rotate with a flow of gas through the housing, and a plurality of vanes disposed at circumferentially incremental locations in the housing radially outward from the second edge of the blades. Each blade defines a first edge extending generally radially and a second edge extending generally axially, with the second edge being a leading or trailing edge of the blade that defines a nonlinear profile in radial-axial projection. The blades are subjected to cyclically varying aerodynamic forces as the blades pass in proximity to the vanes during rotation of the rotor, thereby cyclically stressing the blades, the vanes being adjustable to thereby control the flow of the gas through the housing.

According to another embodiment of the present invention, there is provided a method of manufacturing a rotor structured to rotate with a flow of gas through a housing. The method includes providing first parameters defining a geometric configuration of a blade extending radially from the rotor and defining an edge, providing second parameters defining an expected cyclic pressure distribution on the blade during rotation of the rotor in the housing, determining a high displacement portion of the blade being subjected to a relatively higher displacement than adjacent portions of the blade resulting from the expected cyclic pressure distribution, adjusting the first parameters to remove at least part of the high displacement portion from the blade such that the edge of the blade is nonlinear in radial-axial projection, and thereafter forming the blade according to the first parameters.

BRIEF DESCRIPTION OF THE SEVERAL VIEWS OF THE DRAWINGS

Figure 1:
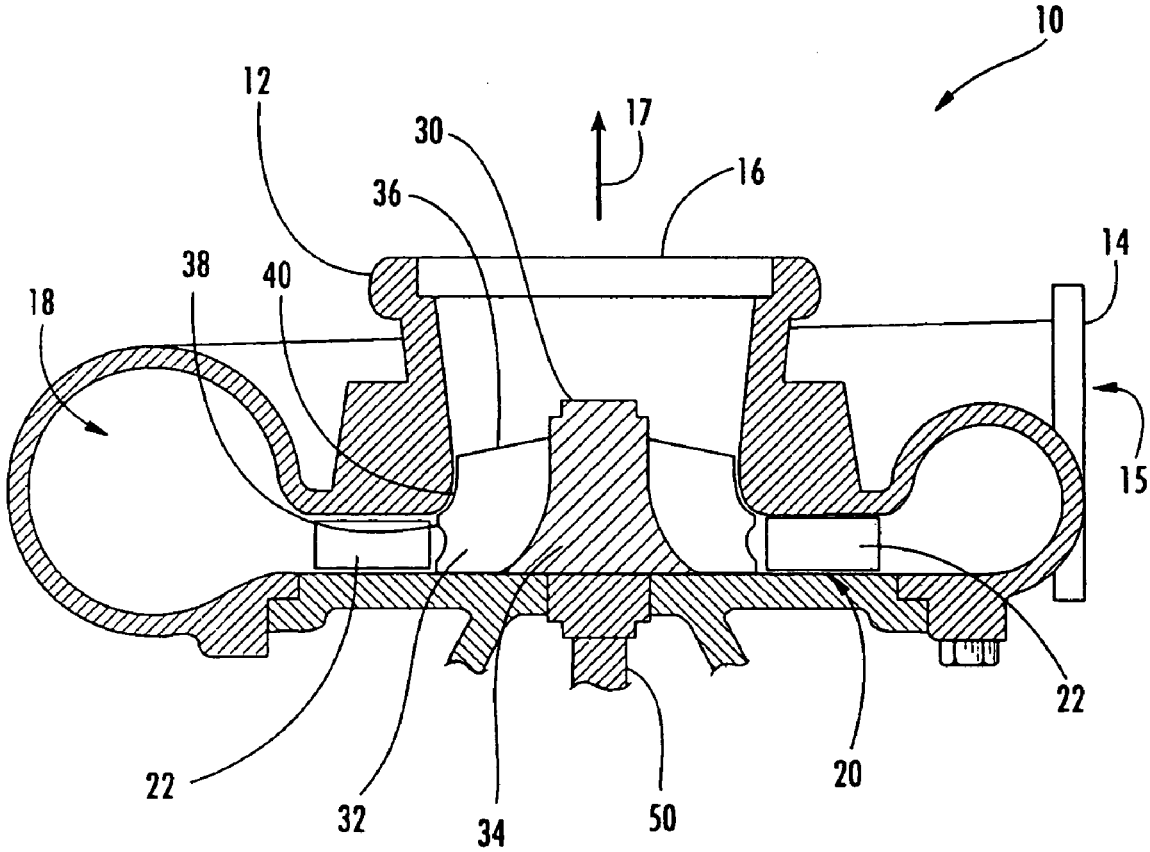
Figure 2:
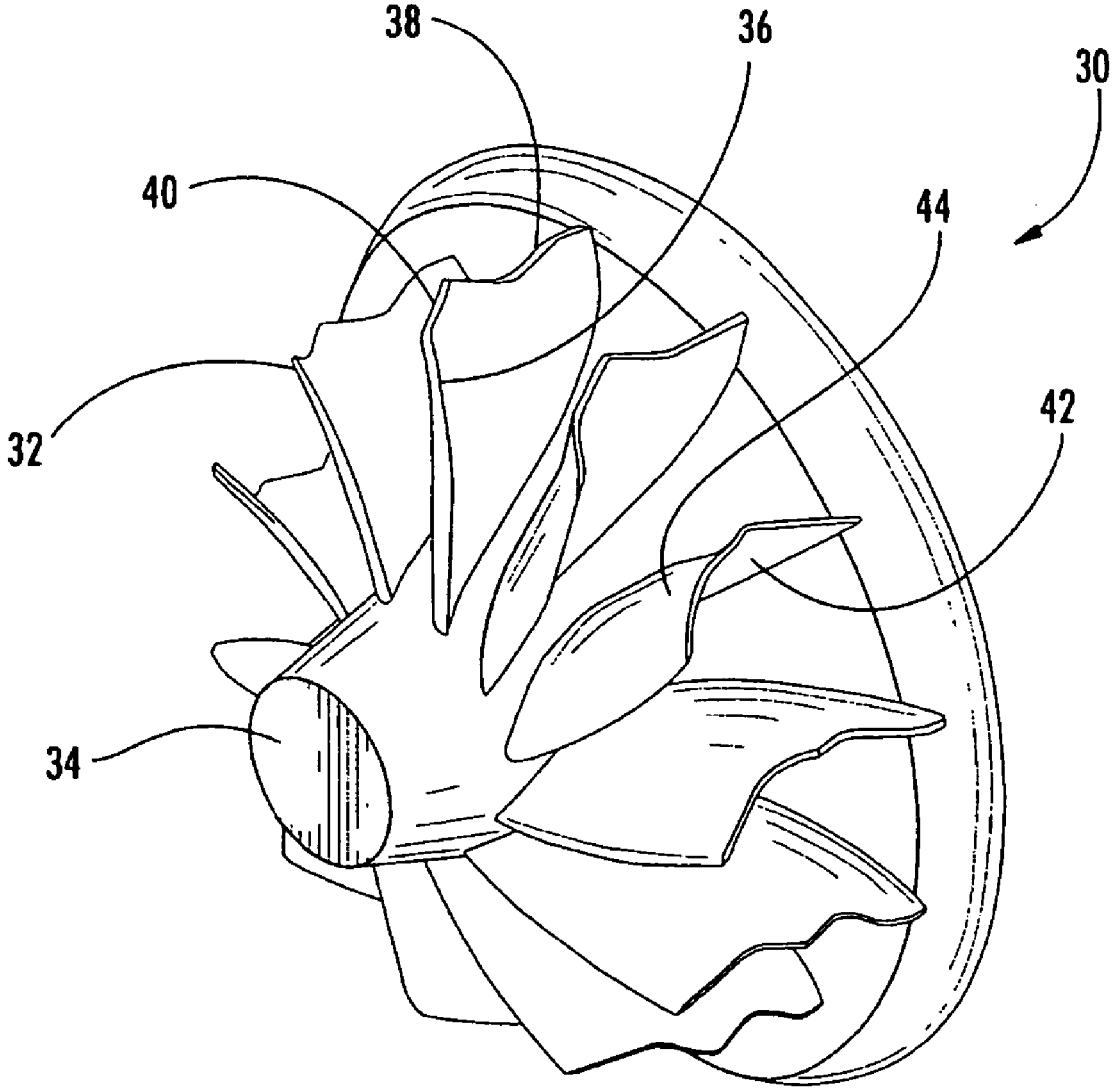
Figure 3:
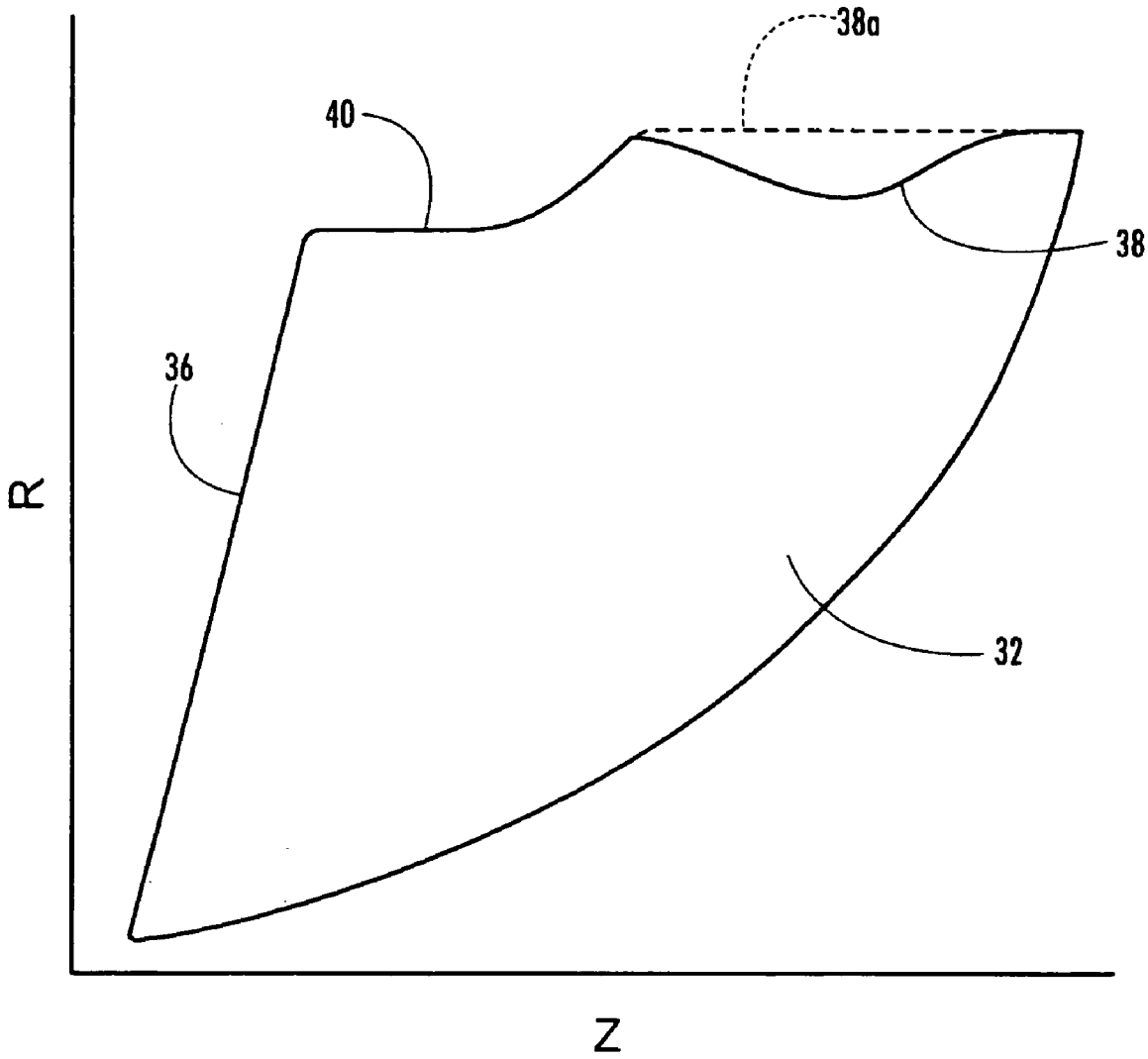
Figure 4A:
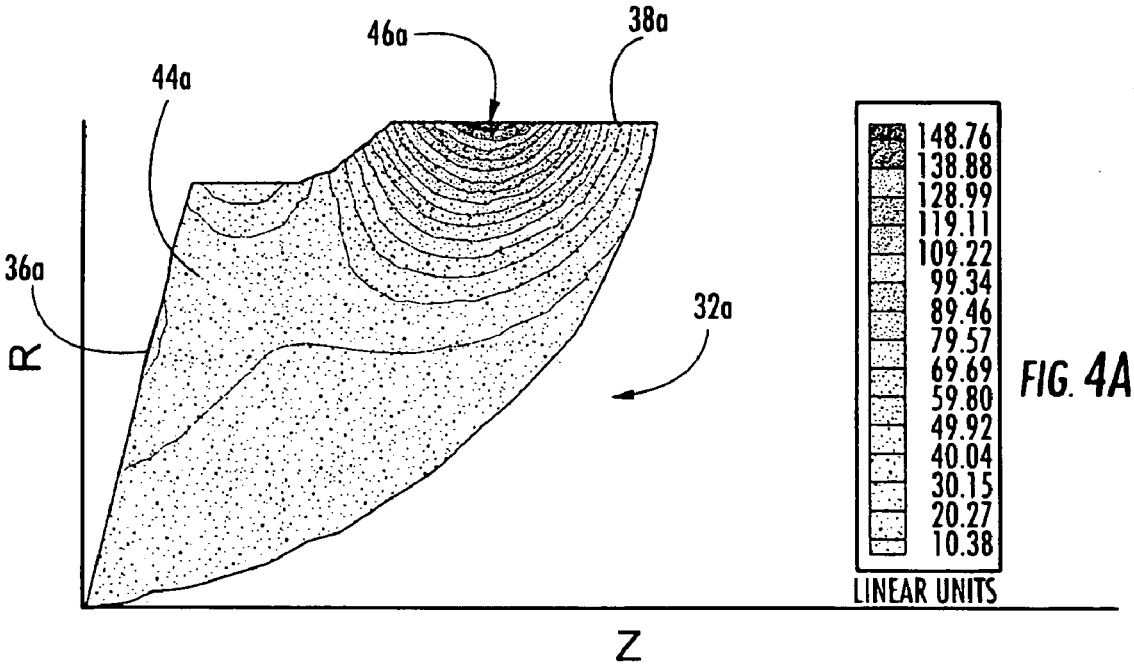
Figure 4B:
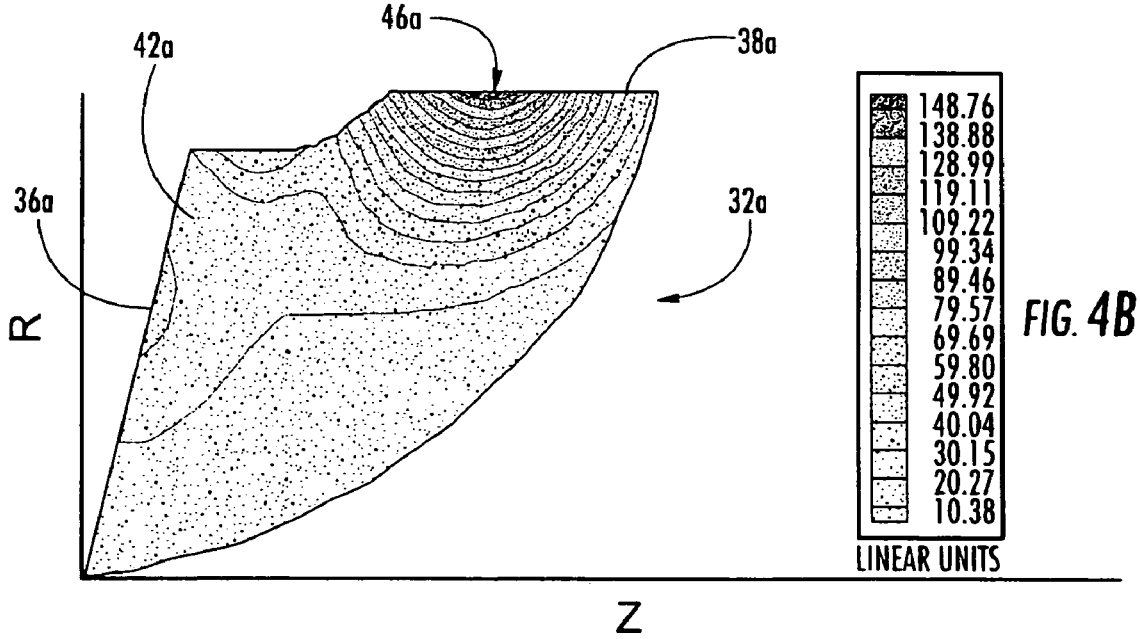
Figure 5A:
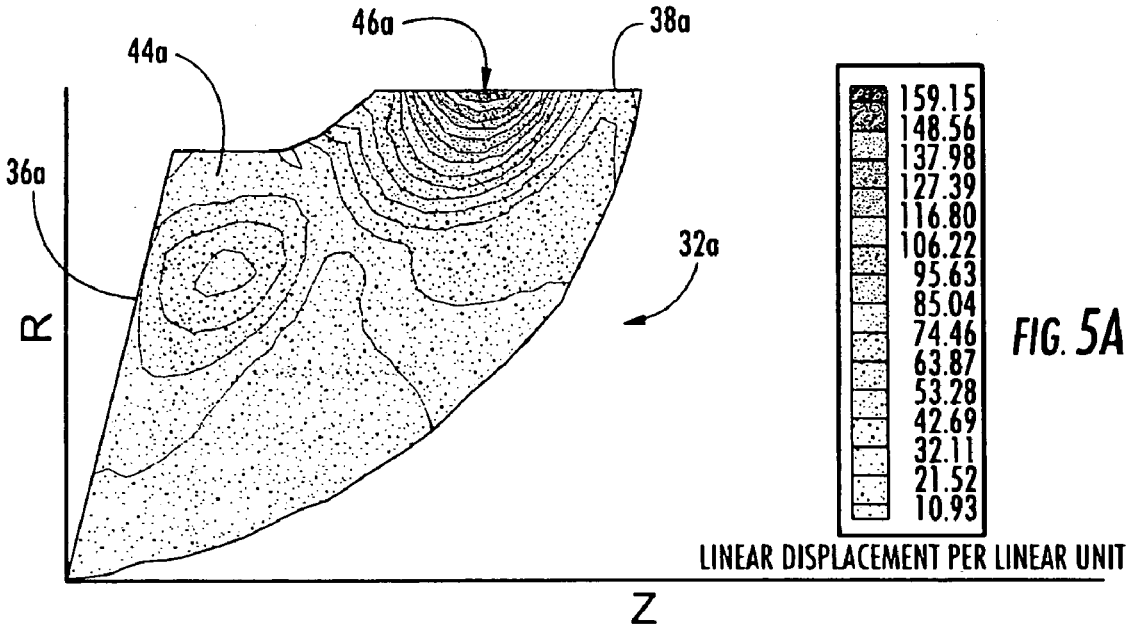
Figure 5B:
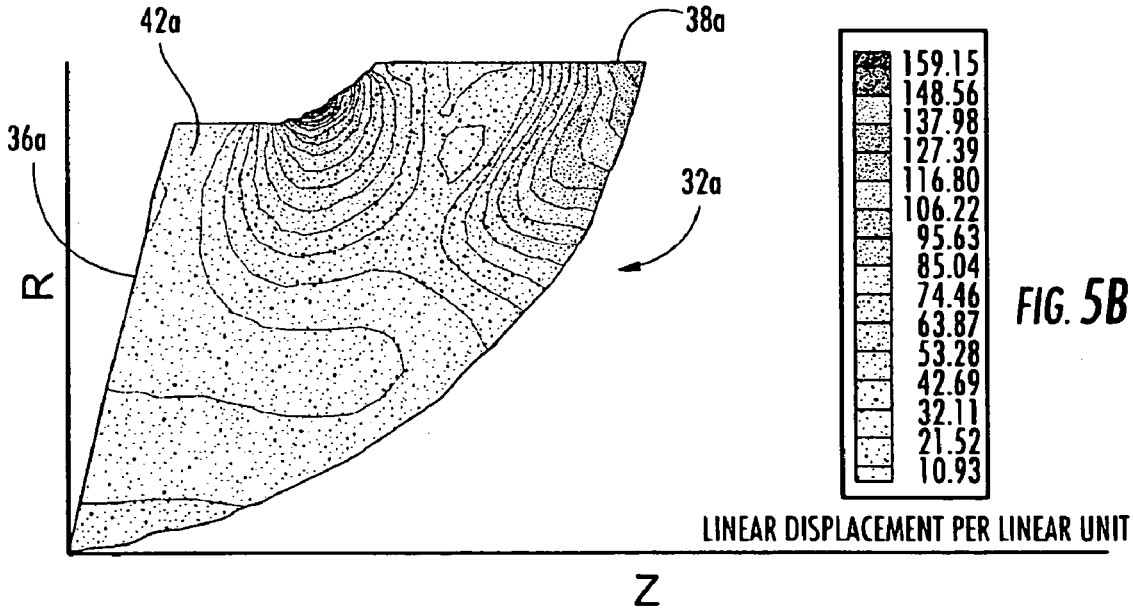
Figure 6A:
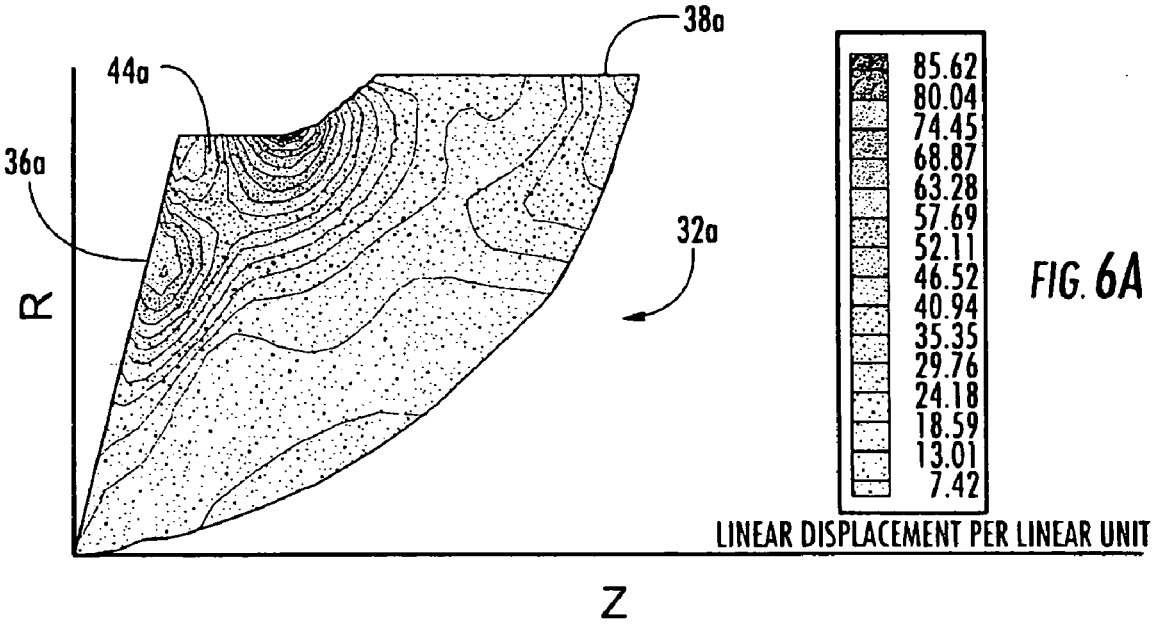
Figure 6B:
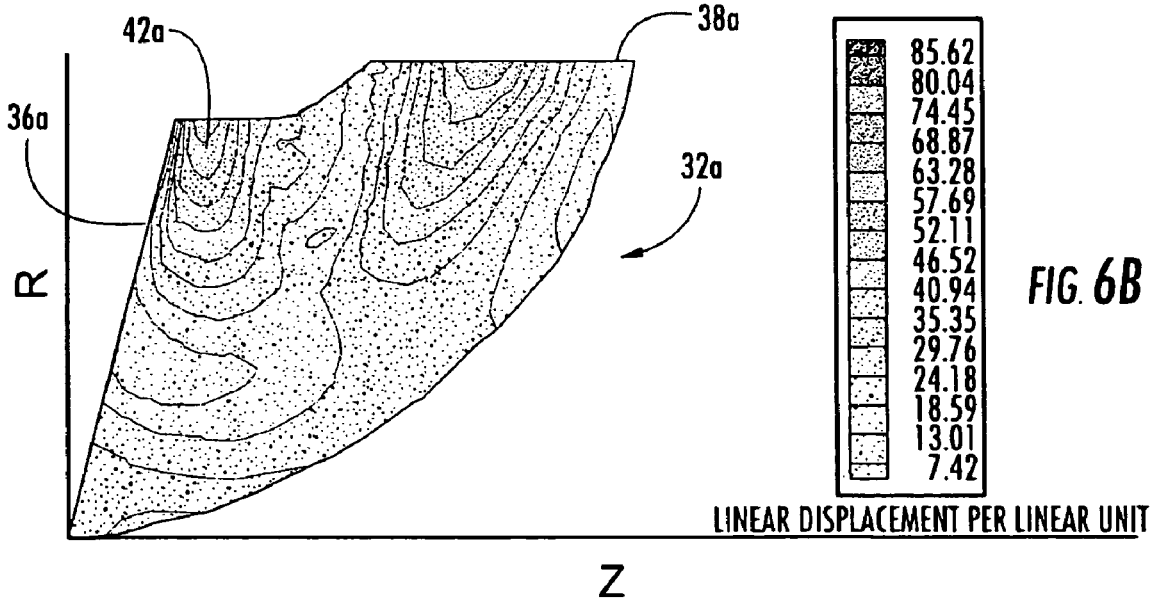
Figure 7A:
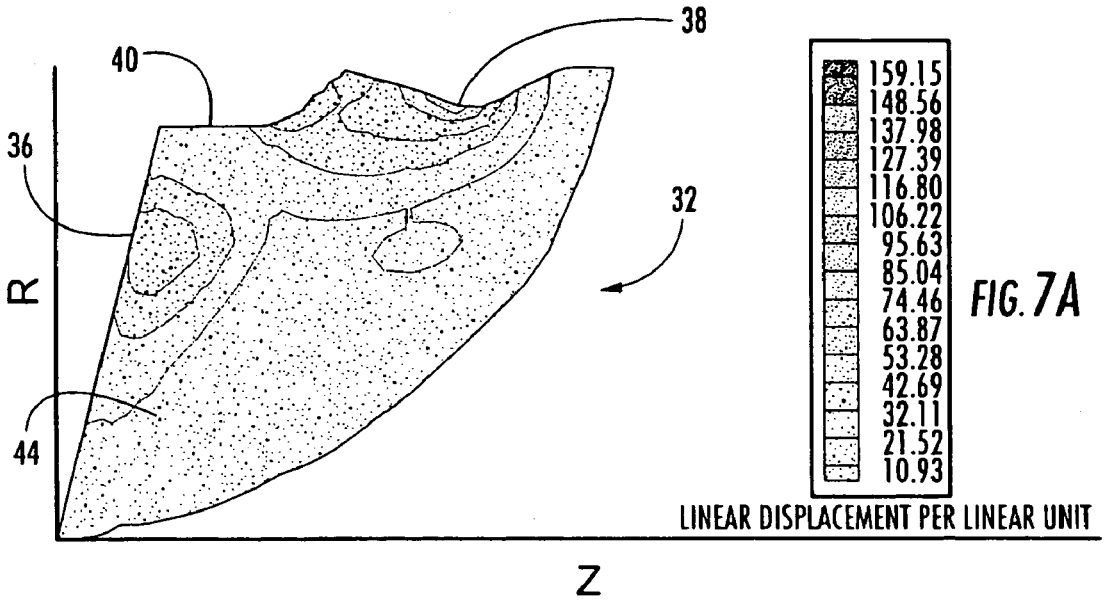
Figure 7B:
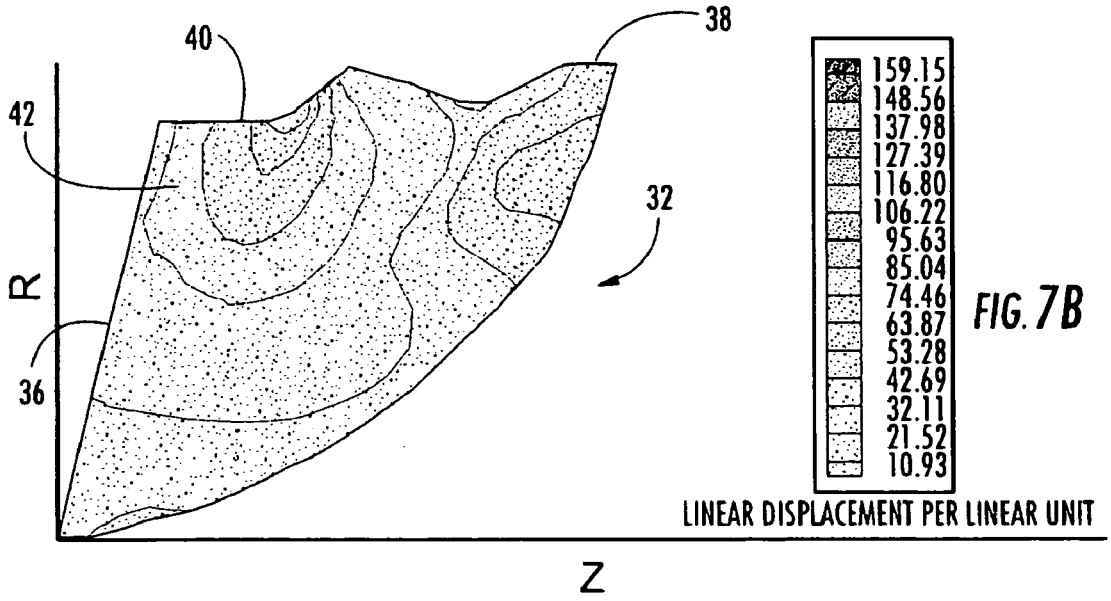
Figure 8A:
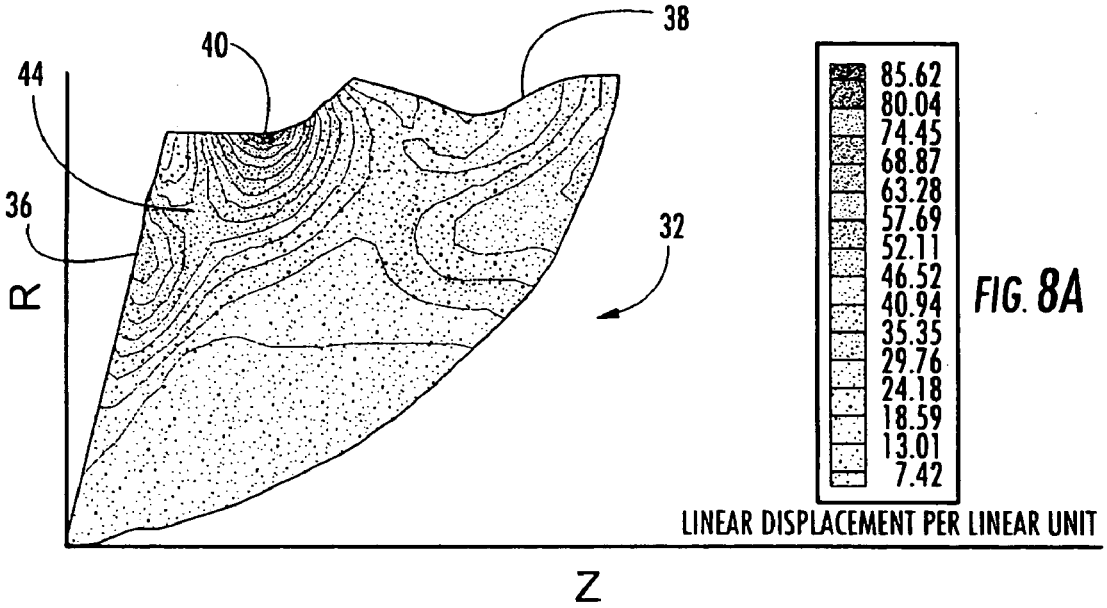
Figure 8B:
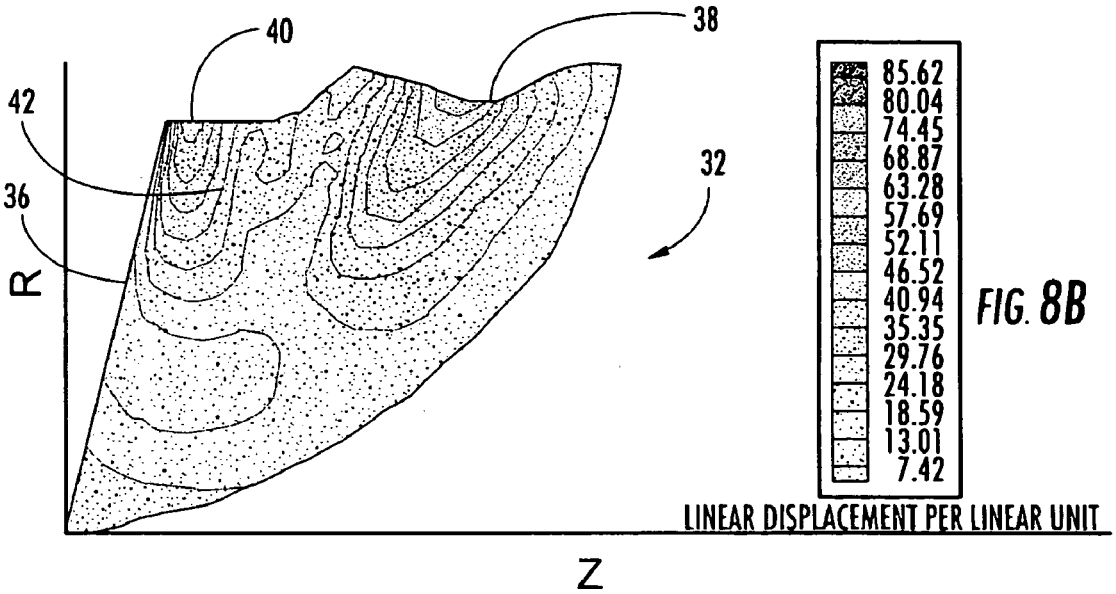
Figure 9:
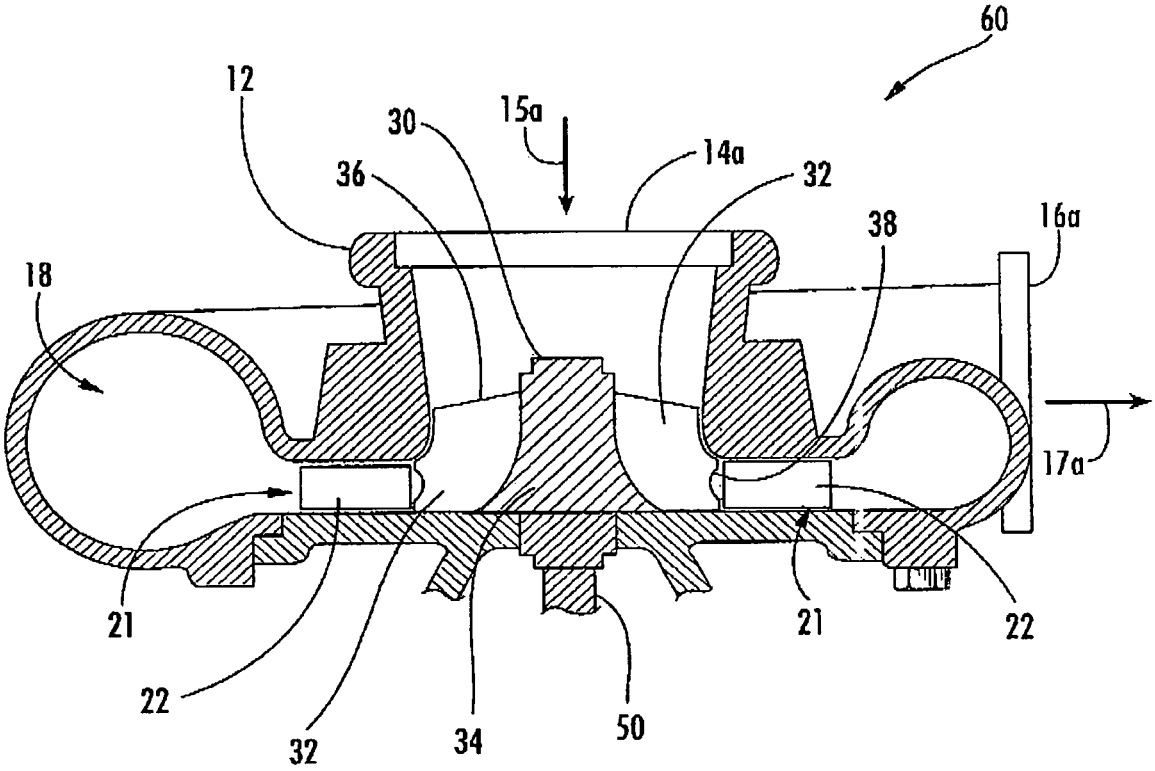

Having thus described the invention in general terms, reference will now be made to the accompanying drawings, which are not necessarily drawn to scale, and wherein:

FIG. 1 is a section view illustrating a rotary apparatus according to one embodiment of the present invention;

FIG. 2 is a perspective view illustrating the rotor of the apparatus of FIG. 1;

FIG. 3 is an elevation view illustrating one of the blades of the rotor of FIG. 2 as compared to a conventional blade;

FIG. 4A is a graph illustrating a displacement pattern at a first side of a conventional blade corresponding to a second vibrational mode of the blade;

FIG. 4B is a graph illustrating a displacement pattern at a second side of the conventional blade of FIG. 4A corresponding to the second vibrational mode of the blade;

FIG. 5A is a graph illustrating a strain pattern at the first side of the conventional blade of FIG. 4A corresponding to the second vibrational mode of the blade;

FIG. 5B is a graph illustrating a strain pattern at the second side of the conventional blade of FIG. 4A corresponding to the second vibrational mode of the blade;

FIG. 6A is a graph illustrating a strain pattern at the first side of the conventional blade of FIG. 4A corresponding to a third vibrational mode of the blade;

FIG. 6B is a graph illustrating a strain pattern at the second side of the conventional blade of FIG. 4A corresponding to a third vibrational mode of the blade;

FIG. 7A is a graph illustrating a strain pattern at a first side of the blade of FIG. 3 corresponding to a second vibrational mode of the blade according to one embodiment of the present invention;

FIG. 7B is a graph illustrating a strain pattern at a second side of the blade of FIG. 3 corresponding to a second vibrational mode of the blade;

FIG. 8A is a graph illustrating a strain pattern at the first side of the blade of FIG. 3 corresponding to a third vibrational mode of the blade;

FIG. 8B is a graph illustrating a strain pattern at the second side of the blade of FIG. 3 corresponding to a third vibrational mode of the blade; and FIG. 9 is a section view illustrating a rotary apparatus according to another embodiment of the present invention.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring to FIG. 1, there is shown a rotary apparatus 10 according to one embodiment of the present invention. As shown in FIG. 1, the rotary apparatus 10 is structured to be a turbine, but in other embodiments of the invention, the rotary apparatus 10 can also be used as a compressor. Compressors and turbines according to the present invention can be included in a turbocharger that is used in conjunction with a combustion engine. Alternatively, the rotary apparatus 10 can be used in other applications, e.g., where operating conditions include cyclically varying pressures.

The rotary apparatus 10 includes a housing 12 that defines an inlet 14 and an outlet 16. A rotor 30, which in this case is a turbine wheel, is rotatably mounted in the housing 12 and configured to rotate with the passage of gas through the housing 12. Thus, gas enters the inlet 14 flowing in a direction 15 generally perpendicular to the longitudinal axis of the rotor 30 and a shaft 50, flows circumferentially in a volute 18 extending circumferentially around the rotor 30, and then flows generally radially inward through a nozzle 20 to the rotor 30. The gas exerts pressure on a plurality of radially extending blades 32 on the rotor 30, thereby turning the rotor 30. The gas then flows in a generally axial direction 17 out of the outlet 16 of the housing 12. The rotor 30 is connected to the shaft 50 such that the shaft 50 turns as the rotor 30 is rotated. As used in a turbocharger, the shaft 50 typically extends through a center housing (not shown), where bearings can support the shaft 50 and oil can be provided for lubrication and cooling. Opposite the center housing from the turbine 10, the shaft 50 can be connected to a compressor wheel (not shown) in a compressor such that the compressor is rot atably operated as the turbine 10 rotates the shaft 50.

Stators such as vanes 22 or other flow control devices can be provided in the nozzle 20 to control or adjust the flow of the gas therethrough. For example, the vanes 22 can be arranged at circumferential intervals in the nozzle 20 and configured to be rotatably adjusted, thereby varying the geometry of the nozzle 20 and affecting the flow of gas. Such variable nozzles 20 are further described in U.S. Pat. No. 6,419,464 to Arnold, the entire content of which is incorporated herein by reference. Alternatively, the vanes 22 can be fixed and an axially sliding piston (not shown) can be used for varying the turbine nozzle flow area. It is appreciated that the adjustment of the nozzle 20 can result in an increase in efficiency of the turbine 10 throughout its range of operation.

The rotor 30 includes a body portion 34, which is connected to the shaft 50, and a plurality of the blades 32, which extend generally radially outward from the body portion 34.

By the term "generally radially" it is meant that the blades 32 do extend radially but may also extend in the axial direction of the rotor 30. As illustrated in FIGS. 2 and 3, each blade 32 defines a first edge 36 that extends generally radially and a second edge 38 that extends generally axially. The first and second edges 36, 38 are connected by a shroud portion 40 extending therebetween. The edges 36, 38 are typically configured in close proximity to other portions of the apparatus 10. For example, the shroud portion 40 of each blade 32 can extend to within less than a millimeter of the housing 12, and the second edge 38 can extend to within a few millimeters of the vanes 22 of the nozzle 20.

The second edge 38 of each blade 32 is either a leading or trailing edge of the blade 32. For example, in the case of a turbine, the second edge 38 of each blade 32 is the leading edge, and the first edge 36 is a trailing edge. That is, as the rotor 30 rotates, the second edge 38 contacts gas flowing into the housing 12, and the gas thereafter flows toward the first edge 36. Also, as the rotor 30 rotates, each of the blades 32 passes through a flow field coming off the trailing edge of each of the vanes 22 or other features defined around the circumference of the nozzle 20. The flow field is nonuniform and unsteady relative to the moving blades 32. As a result, the pressure on opposite faces 42, 44 of each blade 32 increases and decreases cyclically. Further, the strain throughout the blades 32 also increases and decreases cyclically at a frequency corresponding to the rotational speed of the rotor 30 and the number and placement of the vanes 22 or other features. Generally, the temporal variation of pressure and strain are not uniform throughout the faces 42, 44 of the blades 32.

Variation in the pressure and strain on the blades 32 can also result from other geometric nonuniformities in the housing 12 or from features outside the housing 12 that affect the flow of gas therethrough. For example, gas flowing into the inlet 14 of the apparatus 10 can be supplied through an intake manifold. Bends in the intake manifold can disrupt the flow of the gas therethrough, such that the gas enters the apparatus 10 with a nonuniform pressure over the cross section of the inlet 14.

Preferably, the second edge 38 of each blade 32 defines a nonlinear profile as projected in the meridional (radial-axial or R-Z) plane. That is, the profile of the second edge 38, as projected in the R-Z plane, is not straight. The nonlinear second edge 38 can include one or more linear portions, but at least part of the edge 38 is nonlinear in the R-Z plane, e.g., including a nonlinearity such as a curved portion or an angle or other discontinuity as projected in the R-Z plane. For example, FIG. 3 graphically illustrates the outer shape, or profile, of the blade 32 according to one embodiment of the present invention. The axes shown in FIGS. 3–8 correspond to the R, or radial, direction and the Z, or axial, direction of the rotor 30. As illustrated in FIG. 3, the profile of the second edge 38 is nonlinear as projected in the R-Z plane. More particularly, the second edge 38 defines a profile in the R-Z plane that is concave such that the curvature of the concave portion defines a center of curvature located radially outward of the second edge 38. In contrast, the linear profile of a second edge 38*a* of a conventional turbine rotor blade 32*a* is shown in dashed line. Advantageously, the nonlinear configuration of the second edge 38 can reduce the strain that is induced in the blade 32 due to the cyclic aerodynamic excitation forces on the blade 32. Preferably, all of the blades 32 of the rotor 30 have second edges 38 that are substantially similar in profile.

According to one embodiment of the present invention, the configuration of the blade 32 is determined by first determining the unsteady pressure on the blade 32 associated with operation and the resulting displacement and strain of the blade 32. The term "displacement" refers generally to the displacement of the blade 32 that occurs in the direction of the unsteady pressure forces on the blade 32. The profile of the blade 32 is then modified to reduce a portion of the blade 32 that is exposed to unsteady high pressure and a high displacement occurring in the direction of the unsteady pressure. For example, the configuration of the blade 32 illustrated in FIG. 3 can be developed by first providing first parameters that dimensionally define a blade, such as the conventional blade 32*a* with the linear second edge 38*a* as shown in FIGS. 4A and 4B. In addition, the first parameters can define the material or other physical characteristics of the blade 32*a* such as the strength or stiffness of the blades 32*a*. Second parameters defining an expected cyclic pressure contour for the conventional blade 32*a* are also provided. The second parameters can define the frequency and amplitude of a cyclic pressure exerted on opposite faces 42*a*, 44*a* of the blade 32*a* as the blade 32*a* is rotated in a housing, e.g., due to the presence of vanes or other features proximate to the blade 32*a*. In particular, the second parameters can define a temporal pressure variation that is nonuniform over a contour, i.e., a distribution of unsteady pressure over each face 42*a*, 44*a* of the blade 32*a*, which results when the blade 32*a* is rotated at a speed such that the cyclic force occurs at a frequency corresponding to the second vibrational mode of the blade 32*a*. A resulting displacement contour or pattern of the blade 32*a*, i.e., defining the displacement throughout the blade 32*a* that results from the cyclic pressure, can also be determined. Similarly, a strain contour can be determined to define the strain throughout the blade 32*a* that results from the cyclic pressure. The pressure, displacement, and strain contours can be determined mathematically, e.g., using a computer program for mathematically modeling the pressure, displacement, and strain according to the first and second parameters. Alternatively, the pressure, displacement, strain, and/or stress on the blades 32*a* can be determined empirically or by other methods.

The displacement and strain contours for each face 42*a*, 44*a* of the conventional blade 32*a* are graphically illustrated in FIGS. 4A, 4B and 5A, 5B, respectively. As shown in FIGS. 4A, 4B, 5A, and 5B, the maximum displacements and strains for the illustrated embodiment generally occur near the second edge 38*a* of the blade 32*a*, i.e., the leading edge for a turbine blade. It can be seen in FIGS. 4A and 4B that a portion 46*a* near the center of the second edge 38*a* is subjected to a displacement that is relatively higher than the adjacent portions of the blade 32*a*. As shown in FIG. 5A, the strain occurring at the same portion 46*a* of the blade 32*a* is also relatively higher than the strain at the adjacent portions of the blade 32*a*. Typically, the portions of the blade 32*a* subject to high strain or displacement coincide at least partially with those portions of the blade 32*a* that are subject to high cyclic pressures.

According to one embodiment of the present invention, the configuration of the blade 32 is modified by adjusting the first parameters that geometrically define the conventional blade 32*a*. More particularly, the first parameters are adjusted to define a nonlinear edge and at least partially remove the portion 46*a* that is subjected to relatively higher displacement than adjacent portions. Thus, the blade 32 illustrated in FIG. 3 has been modified to exclude at least part of the conventional blade 32*a* that is subjected to relatively high displacements. Preferably, the blade 32 can be modified to exclude portions of the conventional blade 32*a* where high displacement coincides with high cyclic pressures, i.e., where the blade 32 is being significantly displaced in the direction of the unsteady cyclic pressure. Advantageously, the modification of the profile of the blade 32 can reduce the strain and stress of the blade 32. For example, FIGS. 7A and 7B illustrate the strain contour of the blade 32 operating at similar operational parameters as the conventional blade 32*a*. The maximum strain on the blade 32 is significantly less than that of the conventional blade 32*a* shown in FIGS. 5A and 5B. More particularly, the highest strains that occur at the second edge 38*a* of the conventional blade 32*a* have been eliminated. Further, the strains near the nonlinear edge 38 of the blade 32 of the present invention are less than the strains that occur in the corresponding portions of the conventional blade 32*a*.

While the present invention is not limited to any particular theory of operation, it is believed that the change in the profile of the blade 32 can result in a change in the mode shape of the rotor 30 to reduce the displacements or strains that result from exciting a particular mode of the rotor 30 with the excitation forces that occur. That is, it is believed that the change of the shape of the blade 32 results in a corresponding change in the mode shape, thereby making the rotor 30 less affected by the excitation forces.

While FIGS. 7A and 7B illustrate the reduction in strain associated with a cyclic force that occurs at a frequency for exciting the blades 32 at the second vibrational mode of the blade 32, it is also appreciated that the nonlinear profile of the blade 32 can also result in a decrease in the strain that occurs in the blade 32 during other modes of operation. For example, FIGS. 6A and 6B illustrate the strain contour of the conventional blade 32*a* during operation at a speed that induces the cyclic force at a frequency corresponding to the third vibrational mode of the blade 32*a*. Similarly, FIGS. 8A and 8B illustrate the strain contour of the blade 32 of the present invention for a cyclic force that corresponds to the third vibrational mode of the blade 32. As illustrated, the strain at the nonlinear edge 38 of the blade 32 is less than the strain at the linear edge 38*a* of the conventional blade 32*a*.

The adjustment of the profile of the second edge 38 need not conform precisely to the portion 46*a* of the blade 32*a* that is subjected to relatively high displacements. Instead, the adjustment of the profile can also be determined in consideration of the strength of the blade 32, the ease of casting or otherwise forming the blade 32, the aerodynamic performance of the blade 32 and, hence, the rotor 30, and additional considerations. For example, as shown in FIGS. 1 and 3, the profile in the generally axial direction can define a smooth and continuous curve from a first end to a second end in order to minimize sharp edges that might otherwise concentrate stress and/or induce unnecessary pressure losses. The change in the profile of the edge 38 can also result in a reduction in the vibrating mass of the rotor 30, which typically increases the natural vibratory frequencies of the rotor 30, possibly increasing one or more of the resonant frequencies of the rotor 30 beyond the operating frequency of the rotor 30.

In addition, the adjustment or modification of the profile of the blades 32 can be performed iteratively, e.g., by repeatedly determining the displacement and/or strain profile of the blades 32 and modifying the blades 32 to exclude one or more portions subjected to the highest displacements.

While the foregoing discussion has described the rotor 30 in the context of a turbine wheel for a turbine, it is also appreciated that the rotor 30 can instead be used for other applications. For example, as shown in FIG. 9, the rotor 30 can be a compressor wheel, and the housing 12 can be a compressor housing for a compressor 60. During operation of a compressor 60, the compressor wheel 30 can be subjected to pressures, displacements, and strains that are similar to those that occur in the turbine wheel. In particulars the compressor wheel 30 can be subjected to cyclic forces, e.g., as a result of the blades 32 rotating in close proximity to a stator such as a vane 22. Typically, when used in a compressor, the first edge 36 of each blade 32 is the leading edge and the second edge 38 is the trailing edge. Thus, air or other gas flows through the housing 12 in the opposite direction from that which is described above, i.e., the air enters axially in a direction 15*a* through inlet 14*a* toward the first edge 36 of the blades 32, is pressurized by the blades 32, and delivered radially outward therefrom to the volute 18. From the volute 18, the compressed air is discharged through outlet 16*a* in a transverse direction 17*a*. In the context of a compressor, the portion of the housing 12 between the rotor 30 and the volute 18 is generally referred to as a diffuser 21, in which the air from the compressor slows in velocity. The vanes 22, which can be adjustable, can be provided in the diffuser 21 to control the flow of the air therethrough. The vanes 22 can be configured in close proximity to the rotor 30 such that the vanes 22 induce a cyclic change in pressure on the blades 32 of the rotor 20 as the rotor 30 rotates, thereby subjecting the blades 32 to a cyclic aerodynamic excitation force. The displacement and/or strain on the blades 32 can be modeled as described above, and the second edge 38 of the blades 32 can be provided with a nonlinear profile to minimize the strain in the blades 32.

In some embodiments of the present invention, the first edge 36 of the blades 32 can also define a nonlinear contour to minimize strains at and proximate to the first edge 36. For example, contouring of the first edges 36 of the blades 32 can be advantageous where the rotor 30 is subjected to cyclic pressure variations at the first edge 36. Such variations at the first edge 36 can be caused, e.g., by inlet guide vanes (not shown), by geometric nonuniformities in the housing proximate to the first edges 36, or by features outside the housing that result in nonuniform flow through the housing 12.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A turbine wheel connected to a shaft and configured to be rotated with the flow of gas through a housing to thereby rotate the shaft, the turbine wheel comprising:

a body portion configured to rotate about an axis; and a plurality of blades extending radially outward from the body portion of the turbine wheel, each blade defining a first edge and a second edge, the first edge extending generally radially and the second edge extending generally axially, wherein the second edge of each blade is a leading edge of the blade and defines a nonlinear, concavely curved profile in radial-axial projection.

2. A turbine wheel according to claim 1 wherein the turbine wheel is configured to be rotated proximate to a plurality of vanes in the housing.

3. A turbine wheel according to claim 1 wherein the first edge defines a profile that extends axially and radially.

4. A turbine wheel according to claim 1 wherein all of the blades are substantially similar.

5. A turbine wheel according to claim 1 wherein the second edge of each blade defines a smooth and continuous concave profile.

6. A turbine wheel according to claim 1 wherein, the profile of the second edge extends smoothly and continuously from a first end to a second end in a generally axial direction, the first and second ends extending radially to a greater extent than a midpoint of the profile between the first and second ends.

7. A turbine wheel according to claim 1 wherein the second edge of each blade defines two axial portions with a concave portion therebetween, the concave portion having a curvature that defines a center of curvature located radially outward of the second edge.

8. A rotary apparatus configured to circulate a gas, the apparatus comprising:

a housing defining an inlet and an outlet;

a turbine rotor disposed in the housing and configured to rotate with a flow of the gas through the housing, the turbine rotor having a body portion configured to rotate about an axis and a plurality of blades extending radially outward from the body portion, each blade defining a first edge and a second edge, the first edge extending generally radially and the second edge extending generally axially; and a plurality of vanes disposed at circumferentially incremental locations in the housing radially outward from the second edge of the blades such that the blades are subjected to cyclically varying aerodynamic forces as the blades pass in proximity to the vanes during rotation of the turbine rotor, thereby cyclically stressing the blades, the vanes being adjustable to thereby control the flow of the gas through the housing, wherein the second edge of each blade is a leading edge of the blade and defines a nonlinear, concavely curved profile in radial-axial projection.

9. An apparatus according to claim 8 wherein the housing defines the inlet radially outward from the turbine rotor, the turbine rotor connected to a shaft and configured to be rotated by the circulation of the gas through the housing and thereby rotate the shaft.

10. An apparatus according to claim 8 wherein the first edge of each blade defines a profile that extends axially and radially.

11. An apparatus according to claim 8 wherein all of the blades are substantially similar.

12. An apparatus according to claim 8 wherein the profile of the second edge of each blade is smooth and continuous.

13. An apparatus according to claim 8 wherein the profile of the second edge of each blade extends smoothly and continuously from a first end to a second end in a generally axial direction, the first and second ends extending radially to a greater extent than a midpoint of the profile between the first and second ends.

14. An apparatus according to claim 8 wherein the second edge of each blade defines two axial portions with a concave portion therebetween, the concave portion having a curvature that defines a center of curvature located radially outward of the second edge.

* * * * *